US005660416A

United States Patent [19]

Schiele et al.

[11] Patent Number: 5,660,416

[45] Date of Patent: Aug. 26, 1997

[54] CLAMPING DEVICE FOR A MULTIPLE-PART GLIDING BOARD, IN PARTICULAR SNOWBOARD

[75] Inventors: Stefan Schiele, Forstinning; Norbert Eugler, Karlsfeld, both of Germany

[73] Assignee: silvretta-sherpas Sportartikel GmbH, Karlsfeld, Germany

[21] Appl. No.: 389,871

[22] Filed: Feb. 17, 1995

[30] Foreign Application Priority Data

Feb. 17, 1994 [DE] Germany ..... 44 05 098.4

[51] Int. Cl.[6] ..... A63C 5/16

[52] U.S. Cl. ..... 280/818; 280/809; 280/14.2

[58] Field of Search ..... 280/842, 601, 280/611, 809, 814, 818, 14.1, 14.2

[56] References Cited

U.S. PATENT DOCUMENTS

| | | | |
|---|---|---|---|
| 3,907,320 | 9/1975 | Charneck | 280/818 |
| 4,770,441 | 9/1988 | Demonsant . | |
| 4,817,988 | 4/1989 | Chauvet et al. | 280/818 |
| 5,551,728 | 9/1996 | Barthel et al. | 280/818 |

FOREIGN PATENT DOCUMENTS

| | | | |
|---|---|---|---|
| 0362782 | of 0000 | European Pat. Off. . | |
| 2599984 | of 0000 | France . | |
| 2611345 | of 0000 | France . | |
| 800880 | 7/1936 | France | 280/842 |
| 2446654 | 8/1980 | France . | |
| 2553670 | 4/1985 | France | 280/818 |
| 2570611 | 3/1986 | France | 280/818 |
| 2579474 | 10/1986 | France . | |
| 2616078 | 12/1988 | France | 280/818 |
| 2647022 | 11/1990 | France | 280/818 |
| 9108618 | of 0000 | Germany . | |
| 4324871 | 1/1995 | Germany . | |

*Primary Examiner*—Brian L. Johnson
*Assistant Examiner*—Min Yu
*Attorney, Agent, or Firm*—McAulay Fisher Nissen Goldberg & Kiel, LLP

[57] ABSTRACT

The clamping device for connecting a snowboard formed from two skis and a center part has a connection member which is supported on the center part so as to be swivelable around a swivel pin, this connection part having hooks formed at its ends which define corresponding receiving openings. Hardware fittings are arranged on the skis, wherein a movable hardware part is supported on a hardware part that is held on the ski in a stationary manner. Each movable hardware part has an eccentric with which hooks cooperate so as to effect a clamping after the rotation of the movable hardware parts and the compulsory rotation of the eccentrics.

10 Claims, 8 Drawing Sheets

CLAMPING DEVICE FOR A MULTIPLE-PART GLIDING BOARD, IN PARTICULAR SNOWBOARD

BACKGROUND OF THE INVENTION a) Field of the Invention

The invention is directed to a clamping device for connecting a multiple-part gliding board formed by skis, in particular a snowboard.

b) Description of the Related Art

Two clamping devices for connecting two skis to form a monoski with the intermediary of a center part are known from FR 25 79 474. In the first embodiment form, a swivelable bar with curved notches arranged at its ends is provided on the center part. The notches cooperate with pins arranged on the ski so that the two skis are pressed together with the center part when the bar is swiveled. In the other embodiment form, each of the parts to be connected has a clip or clamp through which a transverse threaded clamping bolt can be inserted and screwed together by means of a nut. The first embodiment form enables a relatively fast assembly, but in the second embodiment form assembly takes considerably longer as a result of inserting the bolt through the clamps and screwing together. Further, the relatively small nut can be lost. A substantial disadvantage in these clamping devices consists in that they are only suitable for holding together three parts, but are not suitable for elastic deformation for changing the sidecut radius of the assembled gliding board as is proposed in Patent Application P 43 24 871.3. Moreover, these known clamping devices are only suitable for the clamping process and can not also take on other functions.

OBJECT AND SUMMARY OF THE INVENTION

The primary object of the present invention is to provide a fast and convenient clamping device which not only enables a plurality of parts to be joined together to form a snowboard but also enables a deformation of the skis in order to change the sidecut radius. Further, the possibility of using the clamping device or parts thereof for other purposes such as for fastening the binding is also provided.

Proceeding from a clamping device of the type mentioned in the introduction, this object is met according to the invention in that the movable hardware part is supported on the stationary hardware part so as to be rotatable around a bearing pin arranged at the latter vertically with respect to the surface of the ski, and in that an eccentric is constructed at the movable hardware part. A construction of this kind enables not only a quick and dependable connection of a plurality of component parts to form a snowboard in a conventional manner, but also makes it possible, in particular when the two-part hardware fitting is arranged on both skis, to deform the skis elastically in order to increase the sidecut. Further, it is possible, in principle, to use the handle provided for actuating the movable hardware part, or to use the movable or rotatable hardware part itself, as fastening means for arranging a binding on the ski.

Various possible constructions of the invention are explained in more detail in the following.

A first advantageous possibility consists in that the eccentric engages in an opening partially defined by a hook at the end of the connection member. In a snowboard having multiple parts, in which the individual parts are only held against one another, it is sufficient to provide this two-part hardware fitting on one ski. However, if the skis are to be elastically deformed in order to achieve a change in the sidecut, it is advisable to provide two-part hardware fittings on both skis so that the eccentric employed will not be too bulky. The use of two-part hardware fittings arranged on both skis doubles the clamping distance when using eccentrics.

The handle is advantageously supported at the movable hardware part in a swivelable manner so that it can be brought into a favorable position in which it does not impede the use of the snowboard or skis. However, it may also be advantageous if the handle is removable, particularly when the hardware fitting is used to fasten a touring binding. This touring binding can be designed so as to be removable when the two skis are connected to form a snowboard. In so doing, the touring binding can serve as a handle for actuating the hardware fitting.

Another advantageous development of the invention for securing the movable hardware part in the most effective manner possible so that it cannot be detached unintentionally consists in that the stationary hardware part has a base plate which can be secured on the ski, the central bearing pin, and locking ribs in a star-shaped arrangement on the base plate, in that a fixing plate with locking notches adapted to the locking ribs is provided at the movable hardware part, in that the bearing pin penetrates the movable hardware part, and in that a locking lever provided with an eccentric and resting upon the movable hardware part by the eccentric is supported at the projecting end of the bearing pin in a swivelable manner so as to permit the movable hardware part to be lifted corresponding to the height of the locking ribs in one swiveling position of the locking lever so that the two hardware parts can rotate relative to one another and, in the other swiveling position, the locking lever presses the two hardware parts against one another and blocks them when the locking ribs and locking notches engage with one another.

Another possible construction for securing the movable hardware part consists in that the stationary hardware part has a base plate which can be secured to the ski and the bearing pin which penetrates the movable hardware part so as to support it in a rotatable manner. A locking lever with an eccentric is supported on the projecting end of the bearing pin so as to be swivelable, this eccentric having a locking rib which extends in the direction of a swivel pin and can optionally lock into one of two locking notches which extend at right angles relative to one another and are formed on the upper surface of the movable hardware part.

Another possible construction for securing the movable hardware part consists in that the stationary hardware part has a base plate which can be secured on the ski and the hollow bearing pin which is arranged normal to the base plate so as to support the movable hardware part in a rotatable manner, in that the bearing pin has two diametrically opposite slots, each of which receives a rolling body in the longitudinal direction of the axis of the bearing pin, which rolling body projects beyond the wall of the bearing pin on the inside and outside, in that the bearing bore hole of the movable hardware part has at least two recesses which are adapted to the roller bodies and located diametrically opposite one another in pairs, and in that a locking pin which is adapted to the inner diameter of the bearing pin and has two diametrically opposite recesses adapted to the rolling bodies can be inserted into the hollow bearing pin. Depending on the position of the locking pin, the rolling bodies are either pressed into the recesses of the movable hardware part so that the latter is locked or the rolling bodies are released from these recesses to enable a rotation of the movable hardware part and are then inserted into the recess of the locking pin.

According to another advantageous construction of the invention, it is possible in principle to construct the handle as an adapter for a touring binding. Accordingly, it is possible for the handle which is required for actuating the movable hardware part in order to achieve the desired clamping to be used at the same time as an adapter for receiving a touring binding, so that an additional hardware fitting is unnecessary.

A particularly advantageous construction according to the invention consists in that the handle, which is constructed in the region of its free end as an adapter piece for receiving the touring binding, can be inserted into a holder part of the touring binding having an insert enclosure. The adapter piece has an insertion slit which opens toward the free end in its longitudinal direction and has, in the region of the slit, a conical centering bore hole for a fastening screw with a centering cone, which fastening screw penetrates the holder part of the touring binding. As a result of this construction, the handle serves at the same time as an adapter piece for fastening a touring binding on the ski. The insertion slit and the conical centering bore hole in combination with the centering cone effect a clamping of the adapter piece in the insert enclosure of the touring binding.

In a further possibility for using the hardware fitting for fastening a touring binding, a bearing block is arranged on the movable hardware part in order to support a touring binding in a swivelable and detachable manner and serves as a handle for actuating the movable hardware part.

The invention is explained more fully in the following with reference to a number of embodiment examples shown in the drawing.

DESCRIPTION OF THE PREFERRED EMBODIMENT

Figure 1:
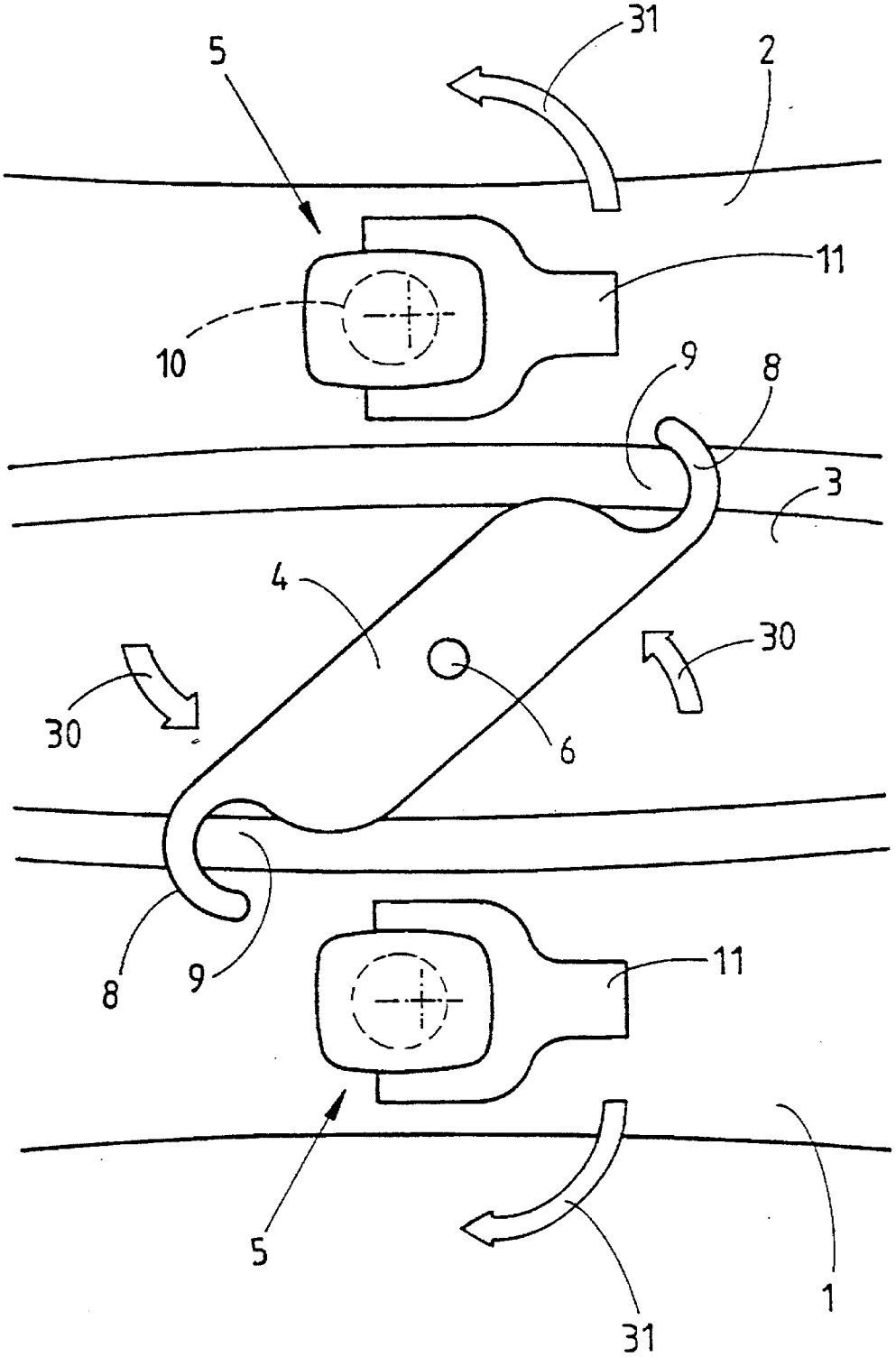
FIG. 1 shows a sectional top view of a multiple-part snowboard in the region of a clamping device before assembly of the snowboard parts.

A clamping device is provided on a snowboard to be assembled from two skis 1 and 2 and a center part 3. This clamping device has a connection member 4 and a hardware fitting, designated in its entirety by 5, which is arranged on each ski 1, 2. In the view shown in FIG. 1, the skis 1, 2 and the center part 3 are already placed next to one another but are not yet clamped together since the connection member 4, which is supported so as to be rotatable around a pin 6 on the center part 3, is located in a position in which the two hardware fittings 5 are not yet connected with one another. FIG. 2 shows the position in which the two hardware fittings 5 arranged on the skis 1, 2 are connected with one another by the connection member 4 but are not yet clamped. Between ski 1 and ski 2 there is a gap 7 indicated by a double arrow. This gap 7 is eliminated in the clamped position according to FIG. 3 by the deformation of the two outer skis 1 and 2. By clamping a snowboard in this way, it is possible to adjust a smaller sidecut radius than is possible when the touring skis and center part are simply joined without a deforming clamping.

At its ends, the connection member 4 has two hooks 8 which partially define an opening 9. These hooks 8 engage around eccentrics 10 which are connected with the hardware fittings 5 and can be rotated by means of handles 11 acting on the hardware fittings 5 and, in so doing, move from the open position according to FIG. 2 into the clamped position shown in FIG. 3. Two hardware fittings 5 and 5.1 with different handles 11 are shown.

Each hardware fitting 5 has two hardware parts which can be constructed differently as will be shown in the following examples.

Figure 3:
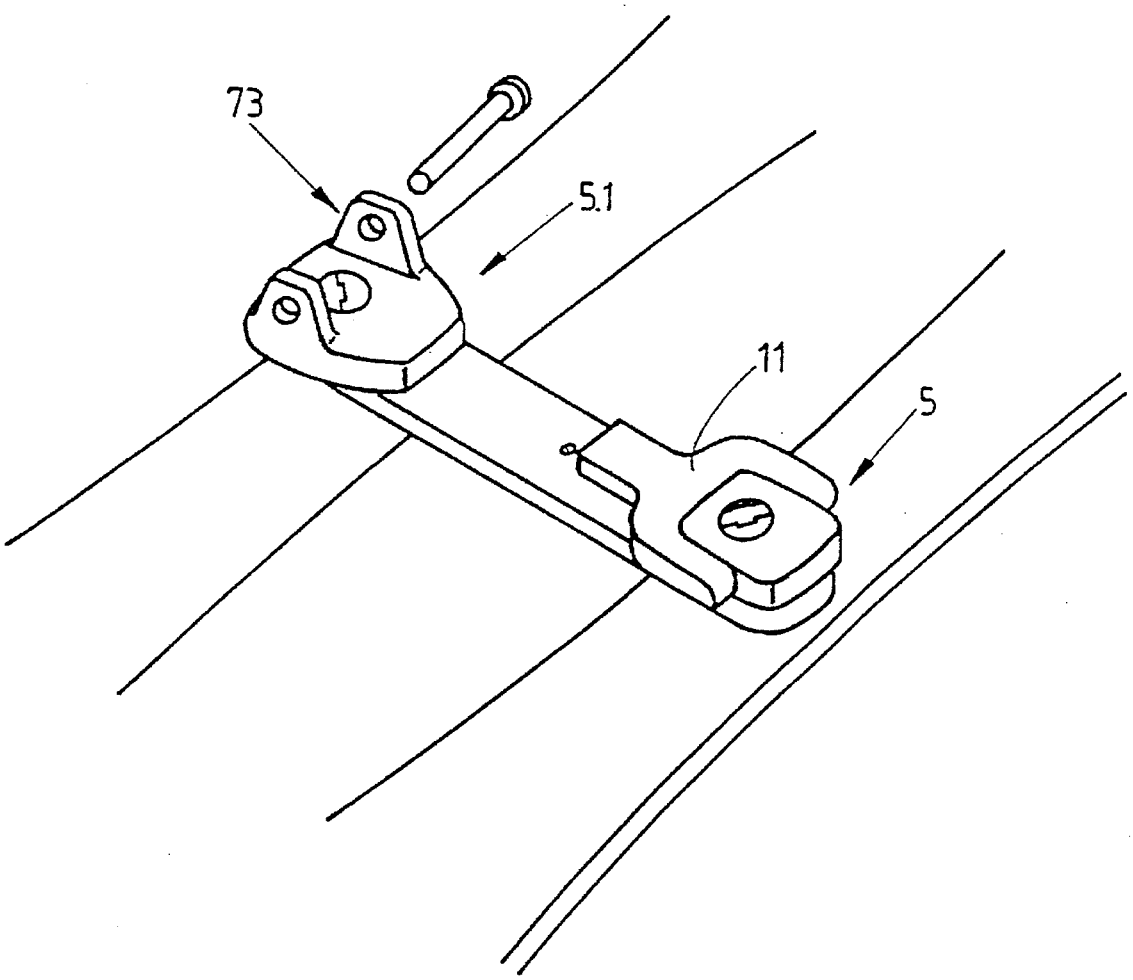
FIG. 3 is a perspective view in section showing the hardware parts on a snowboard which has already been clamped.
Figure 4:
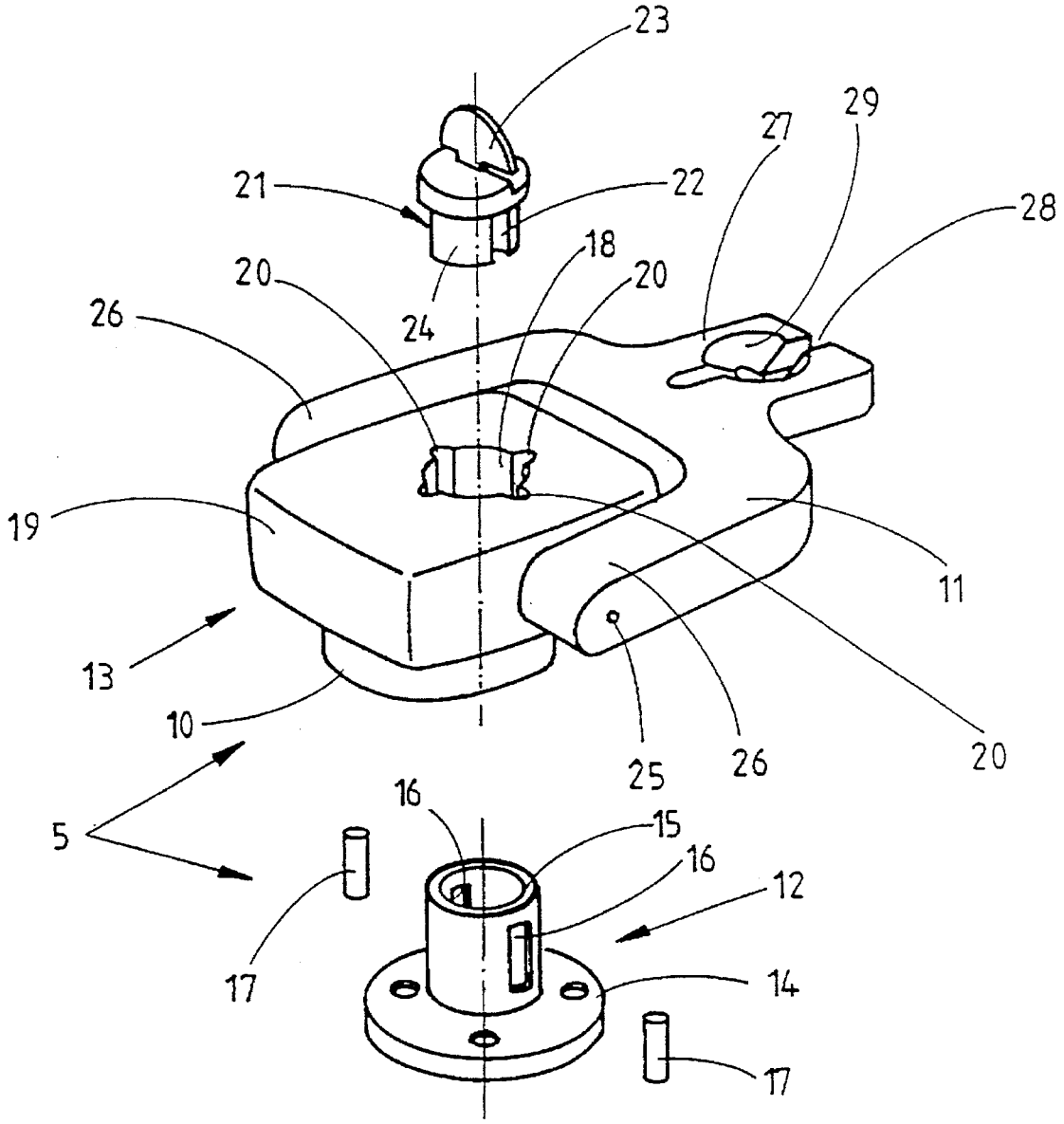
FIG. 4 is an exploded view of a first embodiment form of a hardware fitting of the clamping device.

In the embodiment form according to FIG. 4, the hardware fitting, designated in its entirety by 5, has a stationary hardware part 12 and a movable hardware part 13. The stationary hardware part 12 has a base plate 14, which can be secured to the ski 1, 2, and a hollow bearing pin 15 which is arranged on the base plate 14 and projects vertically to the surface of the ski. The hollow bearing pin 15 has two diametrically opposite slots 16, a rolling body 17 being inserted into each slot 16. The movable hardware part 13 is penetrated by a continuous bearing bore hole 18 and has a base body 19 and an eccentric 10 beneath this base body 19. Four recesses 20 which are offset by 90° relative to one another and are adapted to the rolling bodies 17 are formed in the bearing bore hole 18. The diameter of the rolling bodies 17 exceeds the wall thickness of the hollow bearing pin 15. In the assembled state, a locking pin 21 which is adapted to the inner diameter of the bearing pin 15 and has two diametrically opposite recesses 22 adapted to the rolling body 17 can be inserted from above. A fold-up handle in the form of a fishplate 23 is provided at the upper surface of the locking pin 21 so that the locking pin 21 can be turned. A fork-shaped handle 11 is swivelably supported at the base body 19 of the movable hardware part 13 by a swivel pin 25 and has two legs 26 and an outwardly projecting tongue 27 with an insertion slit 28 and a conical centering bore hole 29 arranged in the region of the slit. The handle 11 serves to turn the movable hardware part 13 around the axis of the hollow bearing pin 15 on the one hand and as an adapter piece for a touring binding 67, 82 on the other hand. This function is explained in the following. The rolling bodies 17 and the associated recesses 20 serve as securing means for securing the movable hardware part 13 relative to the stationary hardware part 12. When the locking pin 21 is inserted into the hollow bearing pin 15 in such a way that the recesses 22 of the locking pin 21 are aligned with the slots 16 in the hollow bearing pin 15, the rolling bodies 17 can deflect into the recesses 22 of the locking pin 21 so that the movable hardware part 13 can be rotated relative to the stationary hardware part 12. The eccentric 10 which is connected in a stationary manner with the base body 19 rotates along with the movable hardware part 13 and, in so doing, effects a clamping via the connection member 4 which engages the eccentric 10 with its hooks 8 as will be seen from FIG. 2. In the position shown in FIG. 2, the eccentrics 10 are rotated in such a way that their respective outer surfaces are at the shortest distance from one another so that the connection member 4 can be hooked onto the eccentrics 10 in the direction indicated by arrow 20 as shown in FIG. 2. By continuing to rotate the movable hardware parts 13 in the direction of arrow 31, the eccentrics 10 are rotated such that the distance between their respective outer wall parts constantly increases so that they are pulled against the center part 3 at skis 1 and 2 until contacting this center part 3, as is shown in FIG. 3. In this position, the movable hardware part 13 must be secured so that the clamping position cannot loosen by itself. For this purpose, the locking pin 21 is rotated by means of the fishplate 23 and the solid wall portions 24 of the locking pin 21 push the rolling bodies 17 into the two recesses 20 of the base body 19 which are offset by 90° relative to swivel pin 25. However, since the rolling bodies 17 are also held in the slots 16 at the same time, the base body 19 is blocked relative to the hollow bearing pin 15. The two other recesses 20 which are aligned with the swivel pin 25 serve to block the movable hardware part 13 in the position shown in FIG. 1 in which the handle 11 comprising the tongue 27 serves to receive a touring binding 67, 82.

Figure 2:
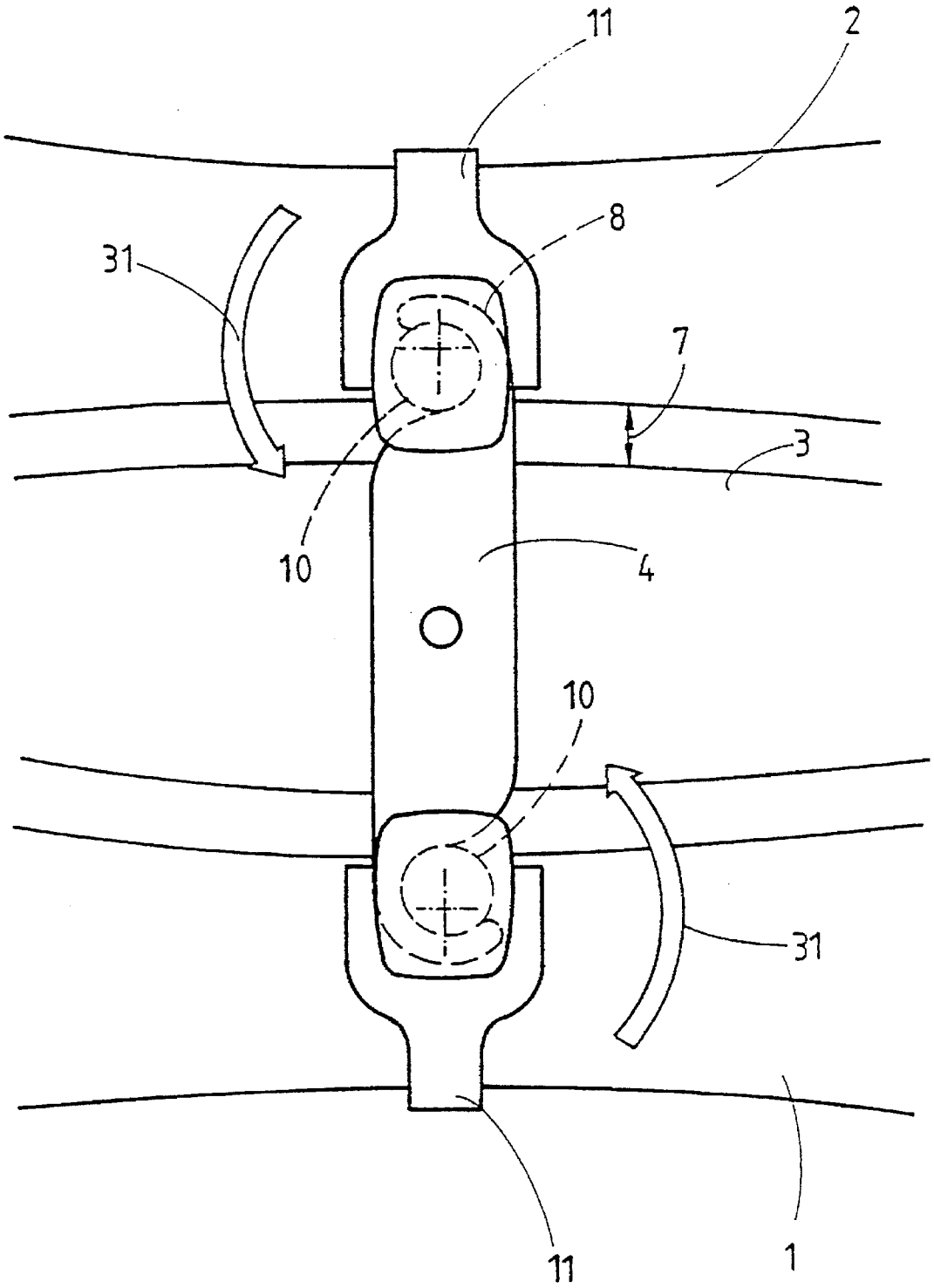
FIG. 2 is a plan view corresponding to FIG. 1 showing the hardware parts in the assembled state before clamping.
Figure 5:
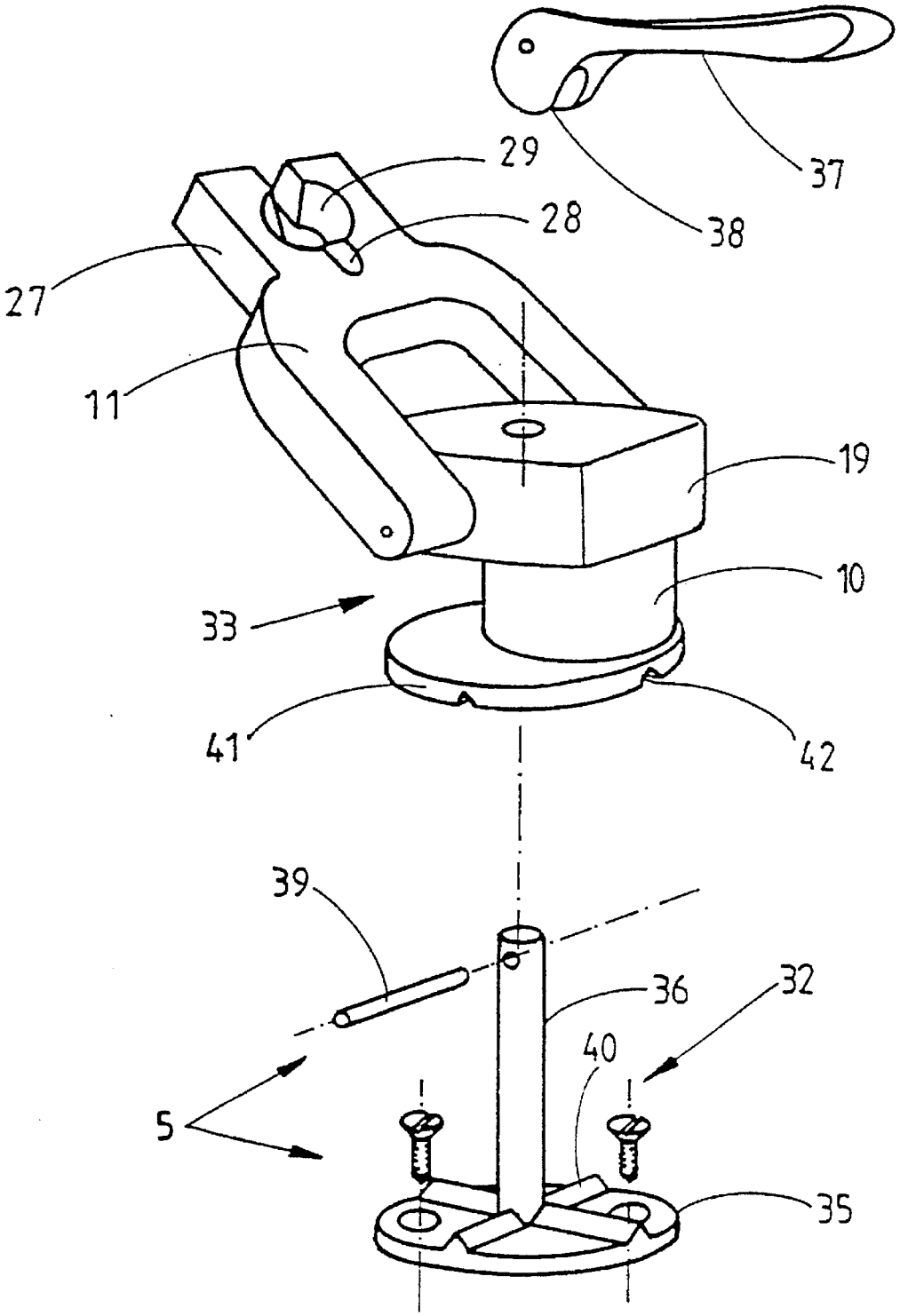
FIG. 5 is an exploded view of another embodiment form of a hardware fitting of the clamping device.

FIG. 5 shows a modified construction of the hardware fitting 5 designated generally by 5 in FIGS. 1 to 3. In this construction, the locking device differs from that of the hardware fitting 5 according to FIG. 4, while the base body 19 is similar and the eccentrics 10 are identical. The handle 11 with tongue 27, insertion slit 28 and conical centering bore hole 29 is likewise constructed in an identical manner. In this embodiment form, the stationary hardware part 32 has a base plate 35 which can be mounted on the ski 1, 2 and a central bearing pin 36 upon which the movable hardware part 33 is rotatably supported together with the eccentric 10. The bearing pin 36 which is arranged vertically to the surface of the ski penetrates the base body 19. At the projecting end of the bearing pin 36, a locking lever 37 having an eccentric 38 is swivelably supported by means of a swivel pin 39. The base plate 35 has four locking ribs 40 which are offset relative to one another by 90° and a fixing plate 41 with locking notches 42 adapted to the locking ribs 40 is provided at the underside of the eccentric 10. When the locking lever 37 is swiveled upward in the assembled position, the eccentric 38 allows the base body 19 to be displaced by a distance large enough to allow the fixing plate 41 to move upward so that the locking notches 42 clear the locking ribs 40. In this way, the base body 19 and accordingly the eccentric 10 can be rotated by means of the handle 11 for the purpose of clamping as was discussed with reference to FIGS. 1 to 3. In order to block the movable hardware part 33 relative to the stationary hardware part 32, as is required in the clamping position corresponding to FIG. 3 and in the touring position shown in FIG. 1, the locking lever 37 is swiveled downward so that the eccentric 38 presses the base body 19, and accordingly the eccentric 10 with the fixing plate 41, downward and the locking notches 42 engage with the locking ribs 40.

Figure 6:
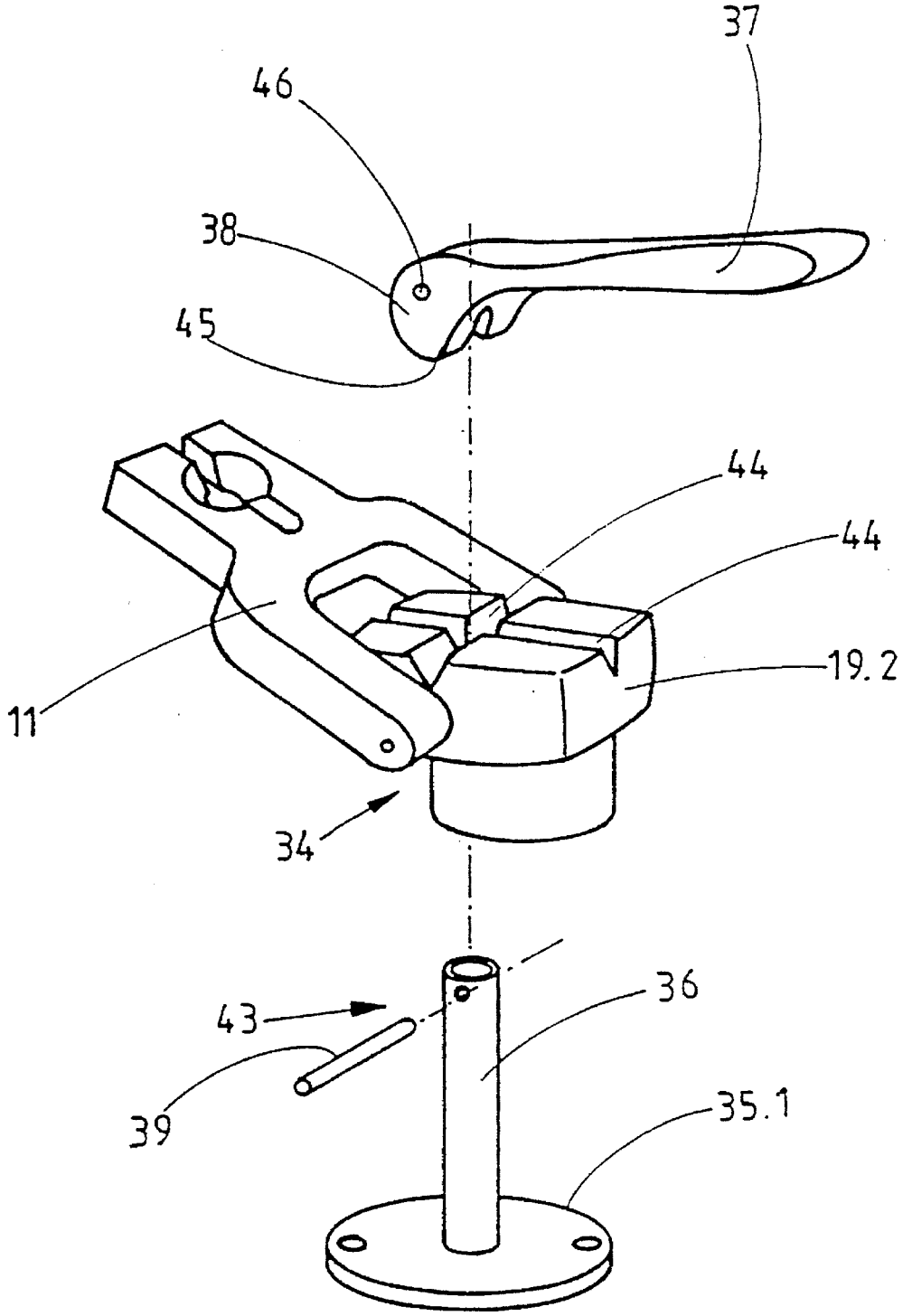
FIG. 6 is a view corresponding to FIG. 5 showing another embodiment form of the hardware.

In the embodiment form according to FIG. 6, which is very similar to that shown in FIG. 5, there are no locking ribs 40 at the stationary hardware part 43 formed by the base plate 35.1 and, bearing pin 36. The fixing plate 41 is also omitted. Another difference consists in that two locking notches 44 which are offset by 90° relative to one another are formed at the upper surface of the base body 19.2 of the movable hardware part 34 and the locking lever 37 has, at its eccentric 38, a locking rib 45 which can lock into the locking notches 44. By swiveling the locking lever 37 upward, the locking rib 45 which extends in the direction of the swivel pin 39 of locking lever 37 moves out of the associated locking notch 44 so that the movable hardware part 34, along with its eccentric 10, can be rotated by means of the handle 11 for clamping purposes. In the clamping position, the locking lever 37 is then swiveled downward again so that the locking rib 45 cooperates with one of the locking notches 44 and accordingly blocks the movable hardware part 34 in the clamping position according to FIG. 3 or in the touring position according to FIG. 1, since the locking lever 37 is swivelable at the bearing pin 36, but is not rotatable in the rotating direction of the movable hardware part 34.

Figure 7:
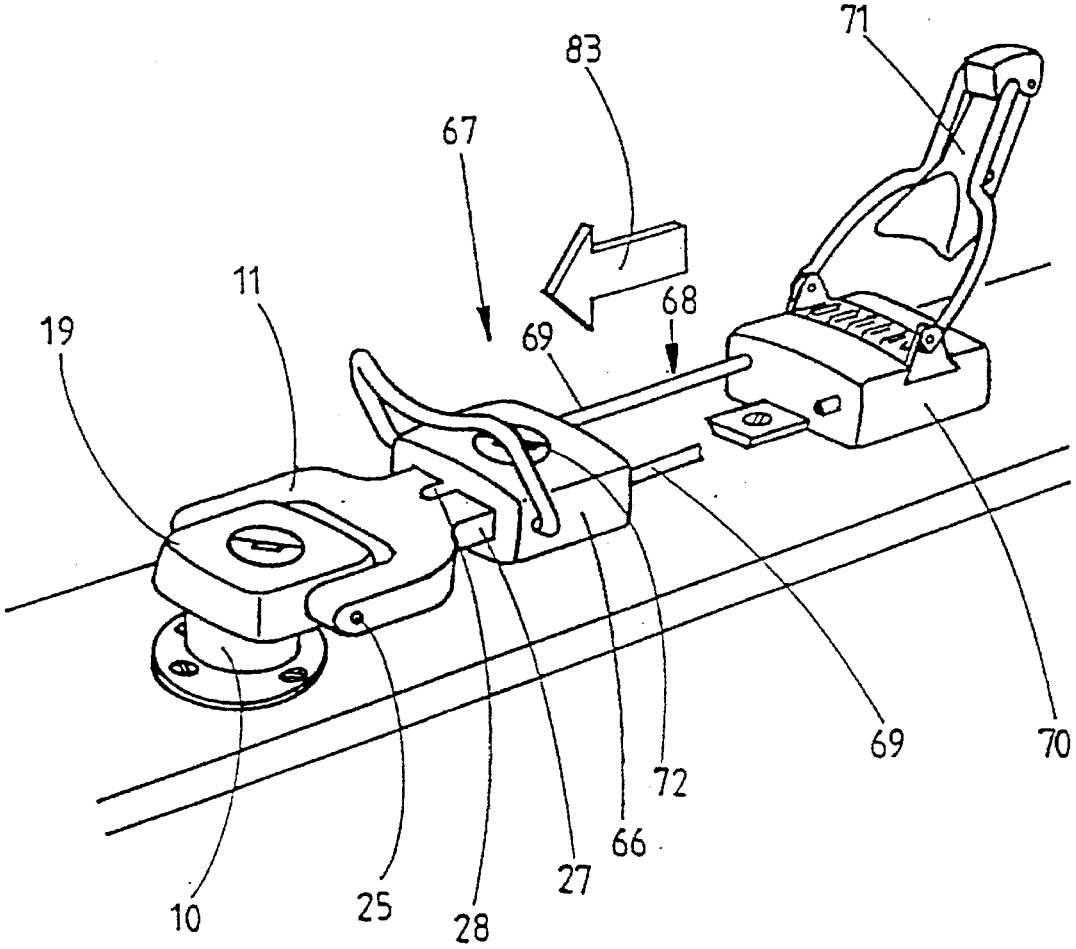
FIG. 7 shows a hardware part of the clamping device according to FIG. 3 in connection with a touring binding.

FIG. 7 shows the use of a hardware fitting, e.g., as shown in FIG. 4, for fastening a binding which is suitable for both the snowboard and, when combined with the hardware fitting, for touring skis. This binding is shorter than a conventional touring binding so that it does not project laterally over the snowboard when used as a binding on a snowboard. In order to use this binding on a touring ski as a touring binding 67, this touring binding 67 is lengthened by means of the handle 11 which is supported at the base body 19 so as to be swivelable around the swivel pin 25. For this purpose, the tongue 27 of the handle 11 engages in an insert enclosure 66 at the touring binding 67, the front termination of the base frame 68 which has two legs 69 [Translator's Note: This sentence is incomplete in the original German]. The legs 69 of the base frame 68 connect the insert enclosure 66 serving as a front sole support with a rear sole support 70 at which a heel tightener 71 is swivelably supported. The touring binding 67 can be secured at the hardware fitting by tightening a fastening screw 72 after sliding the insert enclosure 66 onto the tongue 27 in the direction of arrow 83. This fastening screw 72 has a centering head at its upper end which engages in the conical centering bore hole 29 and accordingly causes the tongue 27 which is split by the insertion slit 28 to spread apart within the insert enclosure 66 so that it is firmly clamped in the insert enclosure 66. The touring binding 67 can then be swiveled around the swivel pin 25 for touring.

Figure 9:
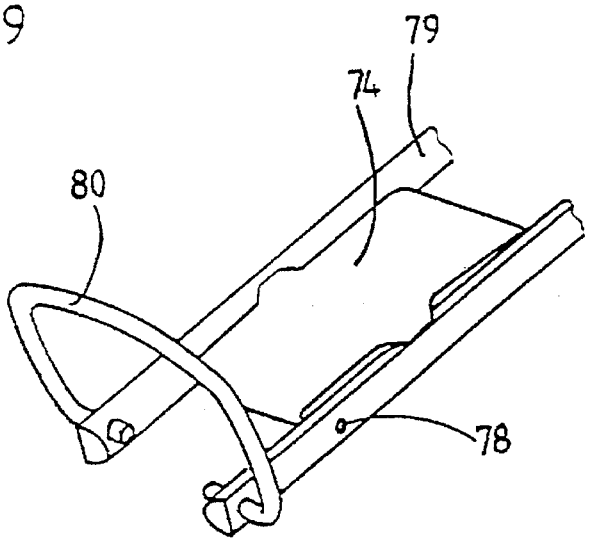
FIG. 9 shows the binding according o FIG. 8 as a snowboard binding.
Figure 8:
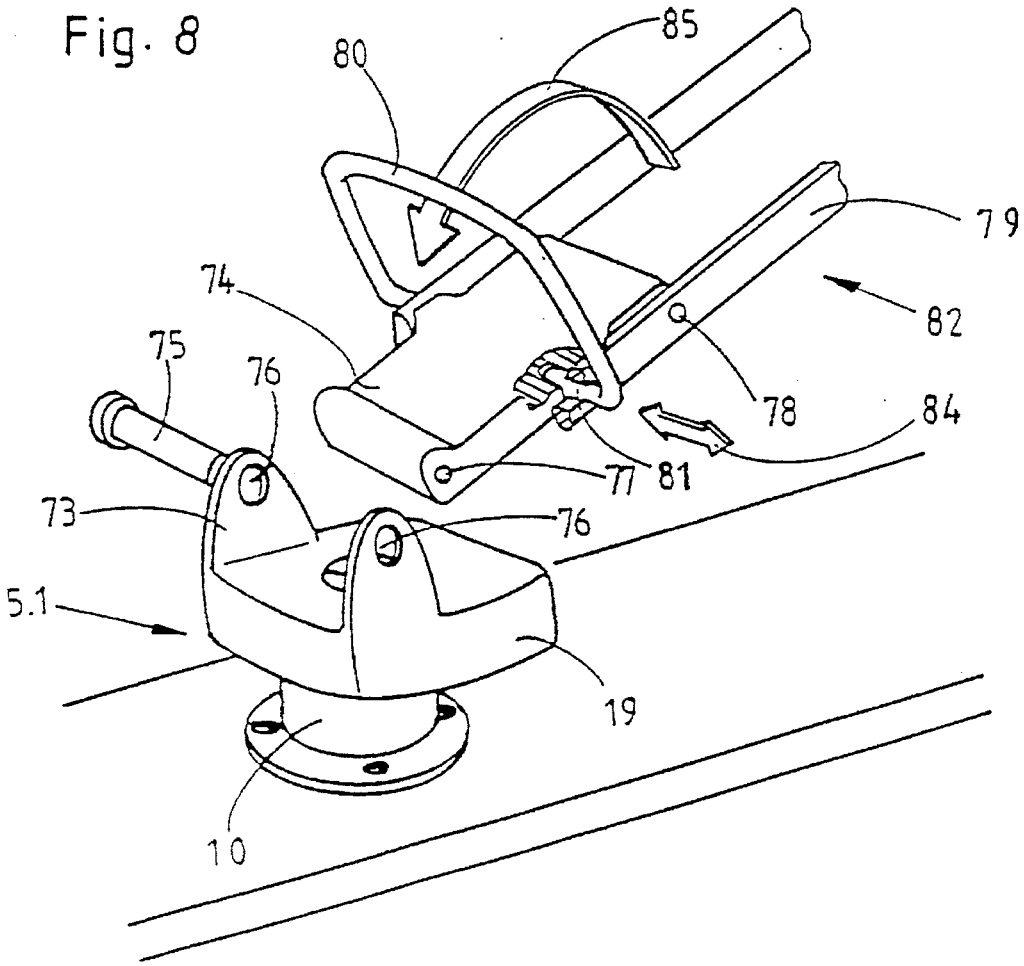
FIG. 8 shows the other hardware part according to FIG. 3 in connection with a touring binding.

FIG. 8 shows another combination of a touring binding 82 with a hardware fitting 5.1 arranged on the ski as is shown in FIG. 3. In this construction, a bearing block 73 is constructed on the base body 19 of the hardware fitting 5.1 and a lengthening piece 74 of the touring binding 82 can be arranged at this bearing block 73 by means of an insertable bearing pin 75. This bearing pin 75 can be inserted not only through the bearing bore holes 76 of the bearing block 73, but also through a bearing bore hole 77 at the front end of the lengthening piece 74 so that the touring binding 82 is swivelably supported at this bearing block 73. The lengthening piece 74 is supported at the base frame 79 of the touring binding 82 so as to be swivelable by means of a pin 78 and is secured at this base frame 79 by a toe stirrup 80. For this purpose, the ends of the toe stirrup 80 which are bent inward and serve as bearing necks 81 engage in corresponding bore holes of the lengthening piece 74. When the toe stirrup 80 is pulled outward in a springing manner in the direction of arrow 84, the bearing necks 81 are freed from the bore holes of the lengthening piece 74 so that the latter can be swiveled to the rear around the pin 78 in the opposite direction of arrow 85. This results in a shorter length of the touring binding 82, as is shown in FIG. 9, which can be used in this state as a snowboard binding 82. When the touring binding 82 is secured at the bearing block 73 in a swivelable manner, the touring binding 82 serves not only as a touring binding but also as a handle for rotating the base body 19, and accordingly the entire movable hardware part which has an eccentric 10 at its underside, in order to carry out the clamping described above.

While the foregoing description and drawings represent the preferred embodiments of the present invention, it will be obvious to those skilled in the art that various changes and modifications may be made therein without departing from the true spirit and scope of the present invention.

What is claimed:

1. A clamping device connecting a pair of skis and a center part, said clamping device comprising:

at least one hardware fitting arranged on each ski; and, a connection member arranged on said center part, said connection member having ends which include connecting means for connecting with said at least one hardware fitting arranged on each ski;

wherein, said at least one hardware fitting is constructed in two parts;

a movable hardware part including an eccentric which is acted upon by said connection member and is movable by a handle transversely to the longitudinal direction of the ski between two positions for securing said hardware fitting to said connection member; and, a stationary hardware part which is connected with the ski, said stationary hardware part further including a bearing pin which projects vertically to a surface of the ski;

wherein, said eccentric on said movable hardware part is supported on said stationary hardware part so as to be rotatable around said bearing pin.

2. The clamping device according to claim 1, wherein the eccentric engages in an opening which is partially defined by a hook at an end of the connection member.

3. The clamping device according to claim 1, wherein the handle is supported in a swivelable manner at the movable hardware part.

4. The clamping device according to claim 1, wherein the handle is removable.

5. The clamping device according to claim 1, wherein the stationary hardware part has a base plate which can be secured on the ski, the bearing pin, and locking ribs which are arranged in a star-shaped manner on the base plate, wherein a fixing plate with locking notches adapted to the locking ribs is provided at the movable hardware part, wherein the bearing pin penetrates the movable hardware part, and wherein a locking lever provided with an eccentric and resting upon the movable hardware part by the eccentric is supported at the projecting end of the bearing pin in a swivelable manner so as to permit the movable hardware part to be lifted corresponding to the height of the locking ribs in one swiveling position of the locking lever so that the two hardware parts can rotate relative to one another and, in the other swiveling position, the locking lever presses the two hardware parts against one another and blocks them when the locking ribs and locking notches engage with one another.

6. The clamping device according to claim 1, wherein the stationary hardware part has a base plate which can be secured to the ski and the bearing pin which penetrates the movable hardware part so as to support it in a rotatable manner, a locking lever with an eccentric being supported on the projecting end of the bearing pin so as to be swivelable, and the eccentric has a locking rib which extends in the direction of the swivel pin of the bearing pin and can optionally lock into one of two locking notches which extend at right angles relative to one another and are formed on the upper surface of the movable hardware part.

7. The clamping device according to claim 1, wherein the stationary hardware part has a base plate which can be secured on the ski and the bearing pin which is hollow and arranged normal to the base plate so as to support the movable hardware part in a rotatable manner, wherein the bearing pin has two diametrically opposite slots, each of which receives a rolling body in the longitudinal direction of the axis of the bearing pin, which rolling body projects beyond the wall of the bearing pin on the inside and outside, wherein the bearing bore hole of the movable hardware part has at least two recesses which are adapted to the roller bodies and located diametrically opposite one another in pairs, and wherein a locking pin which is adapted to the inner diameter of the bearing pin and has two diametrically opposite recesses adapted to the rolling bodies can be inserted into the hollow bearing pin.

8. The clamping device according to claim 1, wherein the handle is constructed as an adapter for a touring binding.

9. The clamping device according to claim 8, wherein the handle, which is constructed in the region of its free end as an adapter piece for receiving the touring binding, can be inserted into a holder part of the touring binding having an insert enclosure, wherein the adapter piece has an insertion slit which opens toward the free end in its longitudinal direction and has, in the region of the slit, a conical centering bore hole for a fastening screw with a centering cone, which fastening screw penetrates the holder part of the touring binding.

10. The clamping device according to claim 8, wherein a bearing block is arranged on the movable hardware part in order to support a touring binding in a swivelable and detachable manner and serves as a handle for actuating the movable hardware part.

* * * * *

UNITED STATES PATENT AND TRADEMARK OFFICE
CERTIFICATE OF CORRECTION

PATENT NO. : 5,660,416

DATED : August 26, 1997

INVENTOR(S) : Stefan Schiele et al

It is certified that error appears in the above-identified patent and that said Letters Patent is hereby corrected as shown below:

Column 6, lines 27 and 28, delete "[Translator's Note: This sentence is incomplete in the original German]"

Signed and Sealed this

Second Day of December, 1997

*Attest:*

Bruce Lehman

BRUCE LEHMAN

*Attesting Officer*

*Commissioner of Patents and Trademarks*